US008733973B2

(12) United States Patent
Menden

(10) Patent No.: US 8,733,973 B2
(45) Date of Patent: May 27, 2014

(54) LIGHTING DEVICE WITH LIGHT EMITTING DIODES

(76) Inventor: Marcus Menden, Essen (DE)

( * ) Notice: Subject to any disclaimer, the term of this patent is extended or adjusted under 35 U.S.C. 154(b) by 219 days.

(21) Appl. No.: 13/265,228

(22) PCT Filed: Apr. 18, 2011

(86) PCT No.: PCT/EP2011/056157

§ 371 (c)(1),
(2), (4) Date: Oct. 19, 2011

(87) PCT Pub. No.: WO2011/134830

PCT Pub. Date: Nov. 3, 2011

(65) Prior Publication Data

US 2012/0092866 A1 Apr. 19, 2012

(30) Foreign Application Priority Data

Apr. 28, 2010 (DE) ..... 10 2010 016 681
Dec. 7, 2010 (DE) ..... 10 2010 061 090

(51) Int. Cl.
*F21S 4/00* (2006.01)

(52) U.S. Cl.
USPC ..... 362/249.02; 362/249.06; 362/311.02; 362/222; 362/225

(58) Field of Classification Search
USPC ..... 362/222, 223, 225, 363, 362/249.02–249.04, 249.06, 555, 240, 246, 362/311.02; 40/449–552
See application file for complete search history.

(56) References Cited

U.S. PATENT DOCUMENTS 4,122,616 A 10/1978 Witt
4,201,003 A 5/1980 Witt
4,201,004 A 5/1980 Witt
4,202,123 A 5/1980 Witt
4,714,581 A 12/1987 Witt
6,042,248 A 3/2000 Hannah et al.
2002/0159257 A1 10/2002 Grajcar
2004/0004827 A1 1/2004 Guest
2005/0077525 A1 4/2005 Lynch et al.

FOREIGN PATENT DOCUMENTS

CN 201063225 Y 5/2008
DE 299 12 986 U1 6/2000
DE 103 22 561 A1 12/2004
DE 10 2007 041 665 A1 3/2008

(Continued)

OTHER PUBLICATIONS

"Fischer LED Buchstaben FL-VP," Fischer Licht & Metall GmbH & Co.KG, brochure, 2008, 5 pp. (with machine translation, 3 pp.).

(Continued)

*Primary Examiner* — Robert May

(74) *Attorney, Agent, or Firm* — Muirhead and Saturnelli, LLC

(57) ABSTRACT

A lighting device has a base body of translucent material, in which several light-emitting diodes, which are applied to a flexible adhesive strip having integrated conductors, are arranged at intervals. A cavity is milled into the rear of the base body, the width and length of the cavity being slightly smaller than the width and length of the base body. A closed edge web is created along the periphery of the base body. An adhesive strip having light-emitting diodes is applied to the interior side of the edge web over the entire length in such a way that light-emitting diodes are arranged on the interior sides of opposing edge web sections. The light-emitting diodes illuminate a solid section of the base body in front of the cavity and produce a high luminous density on the front side. The rear side of the cavity is closed by a cover.

15 Claims, 4 Drawing Sheets

(56) References Cited

FOREIGN PATENT DOCUMENTS

| | | | |
|---|---|---|---|
| FR | 2 936 346 | | 3/2010 |
| GB | 2 268 836 | A | 1/1994 |
| GB | 2 361 989 | A | 11/2001 |
| JP | 3128968 | B2 | 1/2001 |
| WO | WO 03/075249 | A1 | 9/2003 |
| WO | WO 2010/106472 | A1 | 9/2010 |

OTHER PUBLICATIONS

"Colite International's Signature LED Specification Book," Colite International, LTD., brochure, Aug. 23, 2010, 28 pp.

LIGHTING DEVICE WITH LIGHT EMITTING DIODES

TECHNICAL FIELD

The system described herein relates to a lighting device and a method for manufacturing such a lighting device.

With such lighting devices, the base body has the shape of a letter or another symbol or logo which is to be viewed luminously.

BACKGROUND OF THE INVENTION

Such lighting devices are known, for example, from the document WO03/075249 A1. The base body, which is labeled with reference numeral 2 in FIGS. 1 through 9 of this document, is made of bent sheet metal. It is sealed with a light-conducting cover element 3 made of acrylic glass in particular. Using two-sided adhesive tape, the light-emitting diodes are glued to one of the two parallel sections of the U-shaped sheet metal body close to the transverse leg. The distribution of light over the total light-emitting surface of the U-shaped base body should occur due to reflection on the strips formed by the sheets. FIG. 8 shows a measure which should improve the illumination of the entire area. One angle is glued to the lower surface of the leg between the two sections of the U-shaped base body parallel to one another to permit reflection of the rays of light of the light-emitting diodes onto the entire area of the light-permeable light-emitting surface. Alternatively, the specific embodiments of the drawings in FIGS. 26 and 27 disclose a U-shaped sheet metal housing as the base body, which is open toward the wall and permits light to be emitted only toward the wall. Furthermore, a specific embodiment in which the visible front surface as well as the rear surface facing the wall is used as the light-emitting surface(s) is disclosed.

In all cases, the base body must have a substantial height in relation to its width in order to ensure that reflection of the beams of light on the walls of the U-shaped sheet metal housing will lead to complete illumination of the entire light-emitting surface.

The document US 2002/0159257 A1 describes a lighting device having a housing which includes a bottom and inside walls as well as a cover. A strip having electrical conductors, on which the light-emitting diodes are arranged, is applied to the external side wall of the housing. Here again, it is problematic to achieve homogeneous illumination of the visible surface. The document DE 299 12 986 U1 describes a symbolic luminous mark having a light-conducting body made of plastic, in particular in the form of a sheet, assembled with lights. The light-conducting sheet has a narrow channel in its lateral edge area in which light-emitting diodes are arranged. Alternatively, a narrow channel is applied in the middle of the plate, where light-emitting diodes sending light into the exterior regions of the plate are arranged back-to-back.

Accordingly, it would be desirable to create a lighting device which is easily manufactured and has excellent lighting properties, the base body of which may be designed to be very compact. In addition, it would be desirable is to create a method for manufacturing such a lighting device.

SUMMARY OF THE INVENTION

According to the system described herein a hollow space, which is open at one side, is milled into the rear of the base body made of a translucent material, in particular acrylic glass, the width and length of the hollow space being slightly smaller than the width and length of the base body, so that at least one closed edge web running along the periphery of the base body runs in the rear area of the base body, the adhesive strip having the light-emitting diodes being applied to the interior side of the edge web over the entire length in such a way that light-emitting diodes are arranged on the interior sides of opposing edge web sections that face one another and illuminate the solid light-conducting base body in front of the cavity, wherein the cavity is sealed by a cover.

Illuminated letters made completely of PMMA, also known as acrylic glass, are already known. Boreholes or slots are cut in the acrylic glass body. Elongated light-emitting diodes are inserted into these slots or boreholes. Next the cavity is cast with a curable plastic in the slot or the borehole, so that the diode is held fixedly in the body made of translucent material. The main disadvantage of this specific embodiment is that the entire lighting device must be replaced in the event of failure of one diode. Expansion and replacement of the cast light-emitting diodes of the lighting device are impossible.

In contrast, the system described herein proposes cutting a cavity into the rear of the base body of translucent material such as acrylic glass. The contour of the cavity corresponds to the contour of the lighting device (e.g., the shape of a letter), wherein the width and length of the cavity are slightly smaller than the width and length of the base body. This yields a peripheral closed edge web preferably having a width of a few millimeters. When the base body surrounds an open section (for example, the letter "B" or the number "8"), a plurality of peripheral closed edge webs is formed when the cavity is created.

The base body may be made of a milky translucent material in particular. The acrylic glass may in practice have a light transparency in the range of 40% to 80%. Optimal results were achieved in the range of 60%. The milky, cloudy coloration of the acrylic glass causes a diffuse distribution of light over the entire cross section of the lighting device. If a light but spot-shaped illumination of the front of the lighting device is desired, the base body may be designed to be transparent and may simply have a diffusely translucent cover layer.

The edge web offers an optimal surface for applying the adhesive strip having the light-emitting diodes. Finished self-stick strips having light-emitting diodes mounted at regular intervals are known, electrical conductors being directly integrated into these strips. The light-emitting diodes are formed by surface-mountable components, so-called SMD components. The distance between two successive light-emitting diodes, i.e., the distance from the center of one LED to the center of the next LED, is usually in the range between 5 mm and 40 mm. By varying the distance, the desired luminous density of the lighting device can be exactly defined. The adhesive tape, which is supplied as rolls with a length of several meters, may be cut at predetermined locations between two light-emitting diodes and may be contacted. For this purpose, a connecting cable may be soldered to the conductors in the adhesive strip. Mounting such light-emitting diodes on the interior side of the opposing edges of the cavity of an acrylic glass body is very simple and rapid. Furthermore, the adhesive strips or at least sections of the adhesive strips may be replaced if there is damage to individual light-emitting diodes.

The adhesive tape may be provided with monochromatic light-emitting diodes, which emit light of a certain wavelength. Furthermore, the adhesive tape may be provided with white light-emitting diodes. White light-emitting diodes usually consist of three individual diodes, which emit light of different colors. Consequently, adhesive tape may also be used with RGB light-emitting diodes, in which the individual diodes may be triggered individually with the colors red, green or blue and thus the color of the light emitted by the light-emitting diode is variable.

A cover whose contour corresponds essentially to the surface of the lighting device and/or of the base body covers the cavity. At the same time, the cover provides visual protection, so that the user cannot observe the interior of the lighting device. The cover also protects the electronic components of the lighting device from soiling or mechanical stress. Finally, depending on the property of the cover, the illuminated letters may light up toward the rear or may not allow light to escape on its rear side.

Since the light-emitting diodes emit light from edge webs on both sides of an elongated section of the lighting device into the cavity and are arranged relatively close to one another, the light is distributed with a high luminous density uniformly over the entire surface area of the lighting device. This is facilitated in particular by the fact that the light-emitting diodes are arranged on interior sides of opposing sections of the edge web or edge webs that face one another.

The front side of the base body, i.e., the side facing away from the cavity on the rear side may be provided with a translucent cover layer in practice. In particular in the case of colored illuminated letters, but also with white illuminated letters, a cover layer which reproduces the desired color in an especially brilliant manner may be used. The cover layer may additionally be polished to improve the visual impression of the illuminated letter. The cover layer may be simply glued to the remaining section of the base body. The cover layer may be made of high-quality acrylic glass, so that manufacturing the remaining base body from simple acrylic glass offers cost advantages.

The peripheral edge web may have a translucent section on the rear. As a result light from the light-emitting diodes may escape through the edge web on its rear side. In combination with an opaque cover made of metal, for example, this forms a thin luminous strip in the area of the edge of the rear side of the lighting device. In combination with a transparent or diffusely translucent cover, it is possible to achieve the result that the entire rear side of the illuminated letter is translucent.

If the cover is made of an opaque material, its side facing the cavity may have a light color. This results in the beams of light striking the cover being reflected to the opposite side of the cavity, where they enter the base body made of acrylic glass and illuminate it.

As mentioned already, the cover may be made of a translucent material to facilitate the escape of light to the rear side. The lighting device in the form of a letter may be mounted at a slight distance from a wall, for example. Light escaping toward the rear creates a corona effect, i.e., a halo surrounding the letter.

As already mentioned, in the case of a solid light-conducting base body illuminated from the lateral edge web, the luminous density of the total visible front side is very high. With the lighting device according to the system described herein, homogeneous luminance densities on the order of magnitude of 1000 to 2000 cd/m$^2$ may be achieved with a low height of the base body on the order of 35 mm without any inadmissibly great production of heat. The luminous density to be achieved can be controlled via the LED spacing in an excellent manner. If a lower luminous density should be required, the spacing of the light-emitting diodes may be increased without having a negative effect on the uniformity of the illumination. It is also not disturbing that additional elements, for example, a thread for a fastening screw, are provided in the plastic material of the base body in the area of the cavity. The cover may be attached to the base body with a fastening screw, which is screwed into a threaded bore in the base body. A plurality of fastening screws may also be provided to fasten the cover to the base body.

The use of a translucent material such as acrylic glass as the base body of the lighting device has the disadvantage that there is relatively poor removal of heat of the light-emitting diodes. To prevent overheating with light-emitting diodes that are arranged close together or with very powerful light-emitting diodes, a heat-conducting layer, preferably a metal layer, may be provided on the interior side of the edge web. The adhesive strip is then applied to this metal layer. The heat-conducting layer causes a distribution of the heat of the light-emitting diodes at least over the entire area of the edge web. From there, the heat may either enter the material of the base body or be dissipated by convection or radiation into the cavity. The metal layer may be glued to the supporting surface of the aluminum cover, thus forming a heat-dissipating connection between the aluminum cover of the lighting device and the LEDs. Heat is conducted through the adhesive strip carrying the LEDs into the metal layer and through the metal layer into the cover, then being dissipated into the ambient air via the outside of the cover.

The side wall of the lighting device extending from the front side to the rear side may be provided with an opaque coating. Customers usually want the light to emerge either only through the visible front side of an illuminated letter or, if necessary, also through the rear side to create a corona effect. The opaque coating on the side wall prevents unwanted escape of light through this side wall.

It is also possible to provide the outside of the lighting device, which is visible from the front, with an opaque coating. This yields an illuminated letter, which emits light exclusively toward the rear. This illuminated letter may be designed to be particularly flat. Due to the fact that the base body and the edge webs are made of translucent material, manufacturing a lighting device which illuminates exclusively toward the rear and emits light over its entire rear side or also only over the visible area of the edge web is possible with little effort and with a high luminous density.

In the case of an illuminated letter, the distance between the rear side and the front side of the illuminated letter may be between 25 mm and 40 mm to ensure a sufficiently high illumination. In the case of the specific embodiment emitting light only to the rear, in which the front side has an opaque coating, the height of the illuminated letter may be reduced to 20 mm. A satisfactory light distribution is nevertheless achieved.

The opaque coating may consist of a light-impermeable lacquer, which is applied in several layers. A white lacquer coating is preferably applied first to achieve the highest possible reflection in the base body of the illuminated letter. A black lacquer layer is applied next, providing absolute opacity to prevent any light from shining through. Finally the desired exterior color is applied.

In the case of wide lighting devices in particular, i.e., letters, numerals or symbols having a great distance between opposing edge webs, a central web of translucent material, in particular acrylic glass, may be arranged in the center of the base body, protruding out of the base body and extending essentially parallel to the edge web. The center web may in practice have a diffusely reflecting surface. This central web may be created when milling the cavity. Due to the milling, it has a rough milky surface, which partially diffusely reflects light and partially transmits it. The portion of light penetrating through ensures that there is no darkening of the front side of the lighting device in the area of the central web itself. The diffusely reflected component of the light increases the illumination of the lighting device in the central area of the cavity and thus counteracts any darkening of the front side from the edge toward the center. In other words, the surface of the central web lights up brightly due to its diffusely reflecting property and forms a second light source, whose beams of light penetrate into the base body and to its front side. In this way, it is ensured that even with wide lighting devices, no dark area is formed in the center between the edge webs. The central web may in practice extend to the cover, which covers the cavity.

Finally, the system described herein relates to a method for manufacturing a lighting device having a base body in which a flexible adhesive strip is arranged with light-emitting diodes situated at distances from one another and with integrated conductors.

BRIEF DESCRIPTION OF THE DRAWINGS

Specific embodiments of the system described herein are described below with reference to the accompanying drawings, which are briefly described as follows.

DETAILED DESCRIPTION OF VARIOUS EMBODIMENTS

Figure 1:
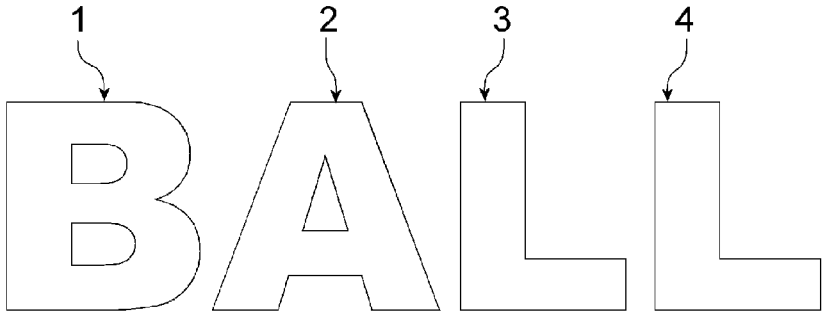
FIG. 1 shows a top view of four lighting devices according to an embodiment of the system described herein.
Figure 2:
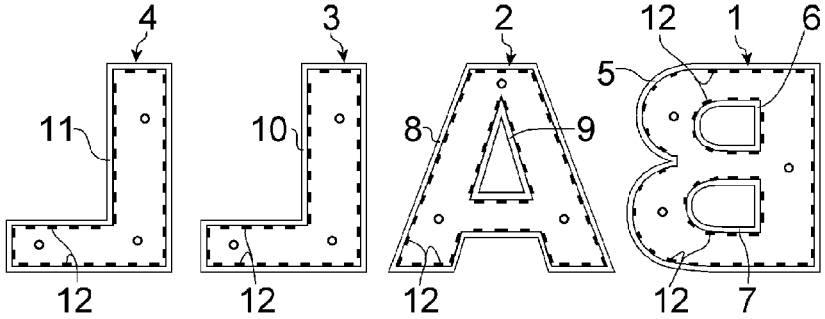
FIG. 2 shows a rear view of the base body of the lighting devices from FIG. 1.
Figure 3:
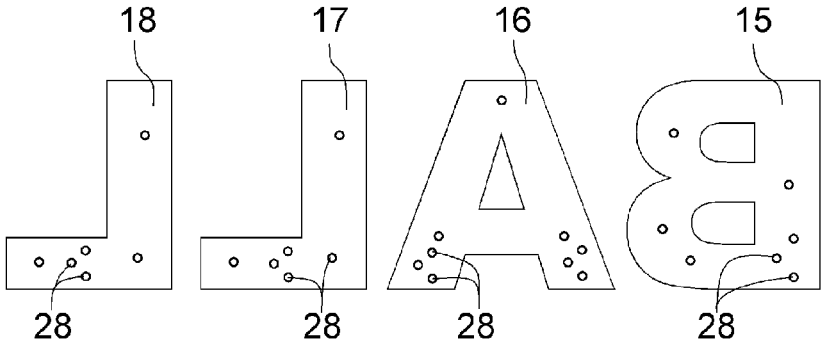
FIG. 3 shows the cover of the four lighting devices from FIGS. 1 and 2.

FIGS. 1 through 3 show four lighting devices whose base bodies 1, 2, 3 and 4 have the letters "B", "A", "L" and "L", respectively.

Each base body 1-4 is made of a translucent plastic, in particular acrylic glass. FIG. 2 shows rear views of base bodies 1-4. This shows that the rear sides of base bodies 1-4 are milled over most of the area of their surface, so that a thin edge web remains on each edge. In the case of a simple letter such as the letter "L," the milled-out cavity on the rear of base body 3 or 4 leads to a closed peripheral edge web 10 or 11 on its outer periphery. The thickness of the edge web depends on the size of the letter. A typical letter may have a height on the order of 200 mm and a width between 100 mm and 200 mm. The thickness of the base body may be between 20 mm and 35 mm, for example. The width of the base body of course depends on the contour of the letter and is typically between 20 mm and 60 mm.

More complex letters, for example, the letter "A," lead to a plurality of edge webs. Base body 2 of the letter "A" has a peripheral outer edge web 8 and a peripheral inner edge web 9. For the letter "B" base body 1 has a peripheral outer edge web 5 and two peripheral inner edge webs 6 and 7.

FIG. 2 also shows that adhesive strips 13 (FIGS. 4 and 5) which carry light-emitting diodes 12 are attached to each peripheral edge web 5-11. Light-emitting diodes 12 are shown more clearly in FIGS. 4 and 5. These are surface-mounted components, also known in English as "surface-mounted devices" (SMD). The SMDs are mounted on flexible strips into which the conductors carrying current to light-emitting diodes 12 are integrated.

Figure 4:
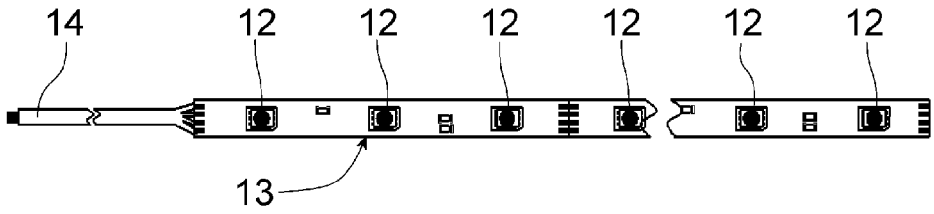
FIG. 4 shows a top view of an adhesive strip having light-emitting diodes for the lighting devices from FIGS. 1 through 3.
Figure 5:
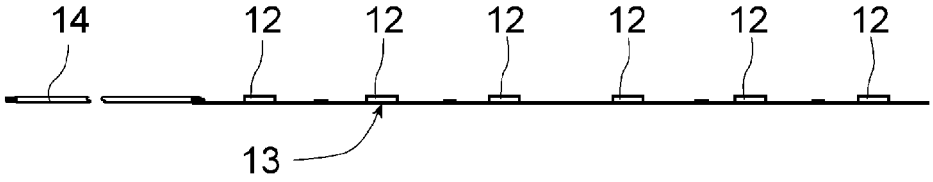
FIG. 5 shows a side view of the adhesive strip from FIG. 4.

FIGS. 4 and 5 show adhesive strips 13 with which light-emitting diodes 12 are attached to the interior side of edge webs 5-11 of base bodies 1-4. The adhesive strips have a width of 10 mm, for example. The distance between two light-emitting diodes 12 is typically between 20 mm and 40 mm. Adhesive strips 13 may be cut at suitable locations between two light-emitting diodes 12. FIGS. 4 and 5 show additional electronic components between light-emitting diodes 12. These may be used for color regulation of the light-emitting diodes. Furthermore, a connecting cable 14 for supplying electricity may be seen at one end of adhesive strip 13.

LEDs 12 may be monochromatic light-emitting diodes in any colors. It is also possible to use SMD light-emitting diodes which are comprised of three separately controllable individual diodes having different color components (e.g., red, green and blue) and may be adjusted to different colors through suitable electronic controls.

Figure 6:
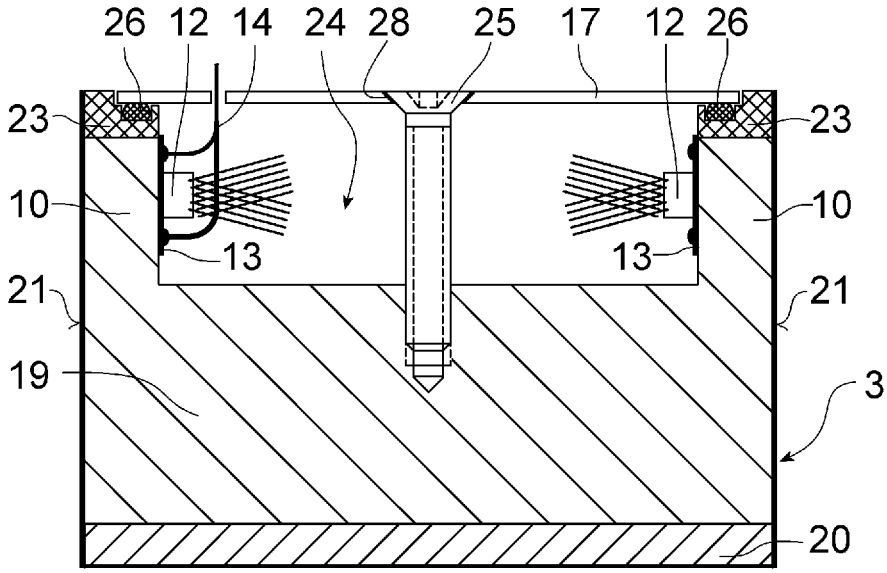
FIG. 6 shows a cross-sectional view of a first specific embodiment of a lighting device.
Figure 7:
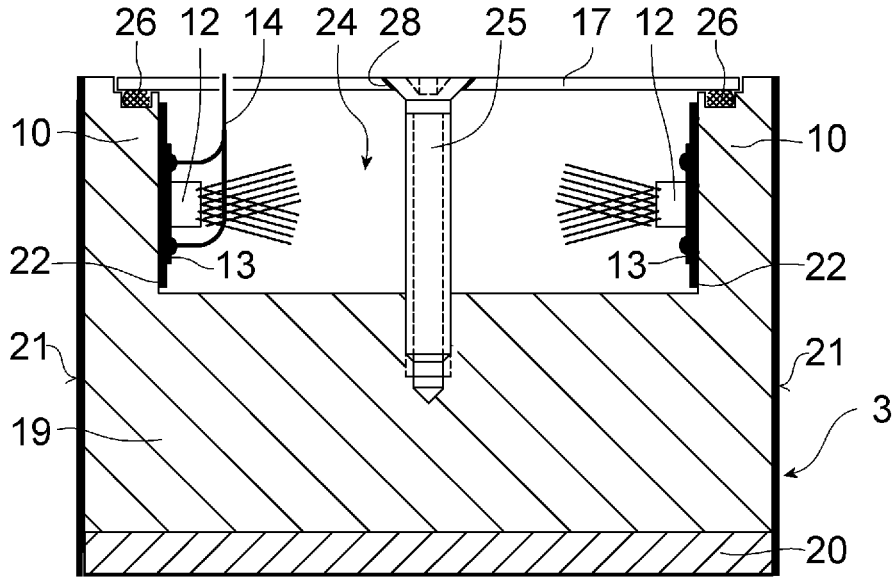
FIG. 7 shows a cross-sectional view of a second specific embodiment of a lighting device according to the system described herein.

FIG. 3 shows covers 15 through 18 of lighting devices 1-4. Covers 15-18 have a plurality of screw holes 28 to receive the heads of fastening screws 25 (FIGS. 6 and 7). Fastening screws 25 are used to attach covers 15-18 to base bodies 1-4 on the one hand and on the other hand to fasten covers 15-18 on a carrying frame or carrying profile, which carries the lighting devices assembled to form a word and secures them in a certain position in space.

FIGS. 6 and 7 show cross-sectional diagrams of two specific embodiments of a lighting device according to the system described herein. Each figure shows a section of base body 3. Base body 3 consists essentially of a solid translucent acrylic glass section 19, i.e., more than half of its height between the front side and the rear side. Another translucent acrylic glass section which has the color of the letter imaged by the lighting device and forms a colored translucent cover layer 20 on base body 3 is glued to the front side of translucent acrylic glass section 19. Essentially translucent solid acrylic glass section 19 of the base body in front of the rear milled-out cavity serves to conduct and distribute the light of light-emitting diodes 12. Front cover layer 20 of colored acrylic glass approximately 3 mm thick forms the surface, which is visible from the outside and lights up in the desired color as brightly and as uniformly as possible.

The side walls of base body 3 are each provided with an opaque coating 21, e.g., a lacquer layer or a paint layer. This may be white or aluminum-colored, for example, and reliably prevents unwanted leakage of light from the side walls.

It is apparent here that cavity 24 is essentially milled into the rear area of translucent section 19 of base body 3. The depth of the milled-out cavity must correspond at least to the width of adhesive strip 13, which is approximately 10 mm, for example. Consequently, edge web 10 is preferably 10-15 mm high. Translucent section 19 remaining in front of edge web 10, i.e., the solid part of base body 3, extends at least over the height of the edge web and thus at least over half of the height of base body 3. In the specific embodiment of FIG. 6, adhesive strip 13 is glued directly onto the interior surface of peripheral edge web 10 of base body 3. In the specific embodiment in FIG. 7, a thin metal sheet which forms a heat-conducting layer 22 is first glued to edge web 10 of base body 3. Adhesive strip 13 is glued to this sheet metal 22. Sheet metal 22 distributes the waste heat of light-emitting diodes 12 uniformly over the entire surface of peripheral edge web 10. Local overheating of peripheral edge web 10 is preventable in this way, and good dissipation of the waste heat of light-emitting diodes 12 can be ensured.

In the specific embodiment in FIG. 7, translucent section 19 of base body 3 extends to the rear side of base body 3. As a result, light from light-emitting diodes 12 is emitted from rear edge web 10 toward the rear. This may be a highly desirable effect. The light emitted toward the rear forms a corona around the illuminated letters.

However, there are also cases in which emission of light to the rear is not desired. In this case, as shown in FIG. 6, rear section 23 of edge web 10 is made of an opaque plastic.

This opaque section 23 in combination with the side surface, which is painted to be opaque, prevents the escape of light from light-emitting diodes 12 on the entire lighting device except for its front side, which is visible from the front. Opaque section 23 is applied to the rear side of translucent section 19, preferably before milling out cavity 24.

The rear side of the lighting device is sealed by cover 17. Cover 17 may be made of aluminum, for example. It is preferably provided with a light paint on the interior side, in particular a white or metallic paint. The light of light-emitting diodes 12 is thus reflected by the side which faces cavity 24 and is reflected in the direction of the front side of the lighting device. However, cover 17 may also be made of colored or white translucent material (e.g., acrylic glass) if it is desirable for the light to be emitted from the rear side of the illuminated letter.

Cover 17 is fastened onto base body 3 by fastening screws 25. Fastening screws 25 are screwed into threaded boreholes 27 in base body 3. The light-conducting property of base body 3 prevents fastening screws 25 from casting shadows on the front side of base body 3. A seal 26 made of silicone, for example, is provided between peripheral edge web 10 and cover 17. This seal prevents dirt from penetrating into cavity 24 and may prevent the escape of light through the gap between cover 17 and edge web 10 if an opaque sealing material is used.

It is also possible to create a lighting device which emits light only toward the rear. In this case, front colored translucent cover layer 20 may be omitted. Instead of this, the front side of the illuminated letter may be provided with an opaque lacquer. In this case, the rear section of the edge webs is of course translucent. The height of an illuminated letter designed in this way may be further reduced. The base body essentially only forms a housing for the light-emitting diodes. This lighting device may have a height from the rear side to the front side on the order of 20 mm.

Figure 8:
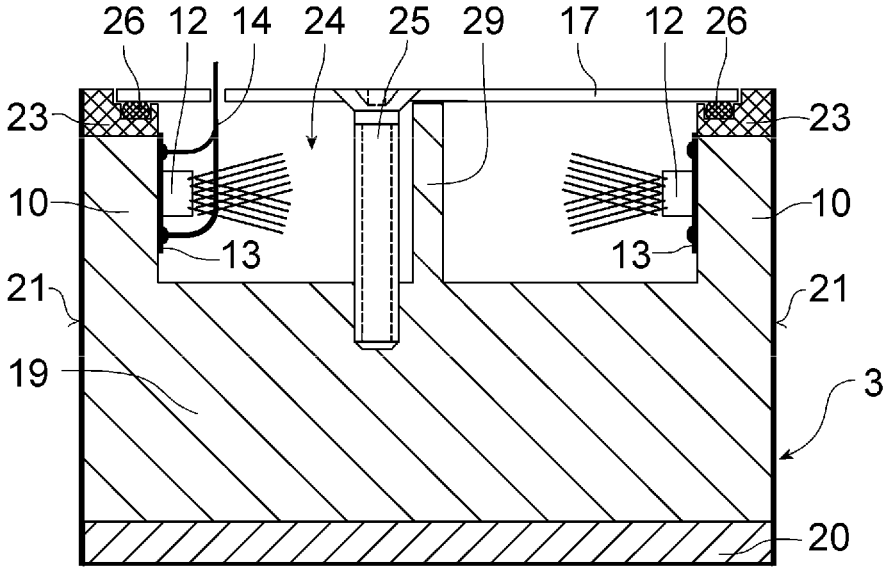
FIG. 8 shows a cross-sectional view of another specific embodiment having a central web.

FIG. 8 shows a specific embodiment of the lighting device having a central web 29. Otherwise the specific embodiment corresponds essentially to the specific embodiment from FIG. 6. Only the position of fastening screw 25 is offset to the left so that it does not pass through central web 29.

Central web 29 is created when milling cavity 24. The diameter of the mill corresponds to the distance between the opposing surfaces of central web 29 and one edge web 10. The cutting edges of the milling cutter create a partially translucent and diffusely reflective structure on both sides of central web 29. This surface structure allows light from light-emitting diodes 12 arranged at the sides to penetrate on the one hand and reflects this light diffusely on the other hand. This ensures that the illumination of translucent acrylic glass section 19 and thus the brightness visible from the front side does not decline in particular in its central area. In the case of translucent acrylic glass sections 19 of a great width, i.e., when the opposing interior sides of edge webs 10 are a great distance from one another, there is the risk that the luminous power of diodes 12 mounted on edge webs 10 will not be sufficient to adequately illuminate the central area. Since the surface of central web 29 diffusely reflects the light of light-emitting diodes 12, another light source which ensures in particular the illumination of the central area is formed by central web 29 at the center of translucent acrylic glass section 19. In the specific embodiment shown here, central web 29 extends to cover 17, which covers cavity 24.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A lighting device having a base body of translucent material in which several light-emitting diodes, which are applied to a flexible adhesive strip having integrated conductors, are arranged at intervals from one another, comprising:

a cavity which is open at one side is milled into a rear side of the base body, a width and length of the cavity being slightly smaller than a width and length of the base body, so that at least one closed edge web running along the periphery of the base body runs in a rear area of the base body, the edge web extending along the periphery of the cavity and having an interior side, wherein the adhesive strip having the light-emitting diodes is applied to the interior side of the edge web over the entire length of the cavity in such a way that light-emitting diodes are arranged on interior sides of opposing edge web sections that face one another, wherein a solid light-conducting section of the base body in front of the cavity is illuminated by the light-emitting diodes on the interior side of the edge web, resulting in a high luminous density on a visible front side of the lighting device, and wherein the cavity on the rear side of the base body is closed by a cover.

2. The lighting device as recited in claim 1, wherein the distance between the rear side and the front side of the lighting device is up to 40 mm.

3. The lighting device as recited in claim 1, wherein the base body has a colored translucent cover layer on the front side opposite the cavity.

4. The lighting device as recited in claim 1, wherein the edge web has an opaque section on the rear.

5. The lighting device as recited in claim 1, wherein the cover is made of an opaque material.

6. The lighting device as recited in claim 5, wherein a side of the cover facing the cavity has a color which reflects the light of the light-emitting diodes and reflects the light in the direction of the front side of the lighting device.

7. The lighting device as recited in claim 1, wherein the cover is made of translucent material.

8. The lighting device as recited in claim 1, wherein the cover is attached to the base body by a fastening screw, and the base body has a threaded borehole into which the fastening screw is screwed.

9. The lighting device according to claim 1, further comprising:

a heat-conducting layer to which the flexible adhesive strip is glued and that is arranged on the interior side of the edge web.

10. The lighting device as recited in claim 1, further comprising:

a side wall, extending from the front side to the rear side, that is provided with an opaque coating.

11. The lighting device as recited in claim 1, wherein a distance between two light-emitting diodes is in the range between 5 mm and 40 mm.

12. The lighting device as recited in claim 1, wherein the base body is made of cloudy translucent material.

13. The lighting device as recited in claim 1, further comprising:

a central web, made of translucent material, that is arranged at the center of the cavity, and protrudes out of the base body and extends essentially parallel to the edge web.

14. The lighting device as recited in claim 13, wherein the central web has a diffusely reflective surface.

15. A method for manufacturing a lighting device having a base body made of a translucent material in which a flexible adhesive strip is arranged with light-emitting diodes situated at intervals and with integrated conductors, comprising:

milling a cavity, which is open at one side having at least one closed edge web running along the periphery of the base body, into a rear side of the base body, a width and length of the cavity being slightly smaller than a width and length of the base body;

gluing the adhesive strip to the interior side of the edge web over the entire length of the cavity in such a way that light-emitting diodes are arranged on the interior sides of opposing edge web sections that face one another and illuminate a solid light-conducting base body in front of the cavity, and closing the cavity on the rear side of the base body by a cover.

* * * * *